United States Patent [19]

Loven

[11] 4,215,502

[45] Aug. 5, 1980

[54] MUZZLE-LOADING FIREARM

[75] Inventor: Carl K. Loven, Cheshire, Conn.

[73] Assignee: Loven Firearms Company, Brookfield, Conn.

[21] Appl. No.: 934,769

[22] Filed: Aug. 17, 1978

[51] Int. Cl.[2] ..... F41C 1/00; F41C 700

[52] U.S. Cl. ..... 42/61; 42/51; 42/75 B

[58] Field of Search ..... 42/51, 59, 61, 75 B, 42/75 A, 75 C, 76 R, 13

[56] References Cited

U.S. PATENT DOCUMENTS

| | | | |
|---|---|---|---|
| 14,118 | 1/1856 | Starr | 42/61 |
| 21,188 | 8/1958 | Elliot | 42/61 |
| 3,296,729 | 1/1967 | Stevens, Jr. | 42/59 |
| 3,616,561 | 11/1971 | Hendricks | 42/59 |

FOREIGN PATENT DOCUMENTS

| | | | |
|---|---|---|---|
| 948800 | 8/1949 | France | 42/75 B |

*Primary Examiner*—Charles T. Jordan

*Attorney, Agent, or Firm*—Allison C. Collard; Thomas M. Galgano

[57] ABSTRACT

A firearm is provided which includes a stock having a barrel end face, a generally longitudinally-extending primary bore formed therein and opening onto the barrel end face, and at least one generally transversely-extending, internally-threaded ancillary bore formed therein one end of which opens onto the primary bore and the other end of which opens onto a lateral face of the stock. The firearm also includes a double barrel having a barrel end plate and a bolt secured to the barrel end plate having an annular groove which bolt is demountably and rotatably received within the primary bore with the groove thereof being positioned such that it opposes the ancillary bore. At least one set screw is threadably receivable in the ancillary bore and has an inner end which is configured and dimensioned to permit mating engagement thereof with the annular groove, so as to retain the bolt in the primary bore while permitting rotation thereof and, in turn, the double barrel.

8 Claims, 6 Drawing Figures

MUZZLE-LOADING FIREARM

This invention relates to a firearm. More particularly, it relates to a muzzle-loading rifle or carbine having a double barrel which is rotatably mounted on the stock of the firearm.

Muzzle-loading rifles which have a rotatable double barrel, such as the "over and under turn barrel type" are well known in the art. The purpose of the rotatable barrel is to permit the user to fire off the top barrel first, which is typically set at a range of fifty yards. Then, the user grips and rotates the barrel so that the bottom barrel is brought into a firing position underneath the hammer; the bottom barrel being typically set for a range of one hundred yards, in case the target is missed on the first shot.

Various prior art constructions have been proposed for rotatably mounting the barrel in the stock of the firearm (see, e.g. U.S. Pat. Nos.: 14,118; 21,188; 3,296,729; 3,369,314; 3,616,561; 3,726,266).

In one prior art method, the barrel is attached to a threaded shaft which is threadably received in a screw mounted in a bore of the stock. However, this method of mounting was found to be disadvantageous since the screw would often loosen causing the barrel to wobble after it was rotated several times.

Moreover, by and large, the other prior art methods have required relatively expensive, complicated and cumbersome mounting assemblies which do not permit easy and facile assembly and disassembly of the stock and barrel. This is quite important for ease of storage and transport.

Accordingly, it is an object of the present invention to provide a novel firearm having a rotatably mounted double barrel which affords a snug but rotatable fit of the barrel on the stock.

It is another object of the present invention to provide such a novel firearm which is of relatively simple and inexpensive construction, and is dependable and reliable in operation.

It is a more particular object of the present invention to provide such a firearm having the foregoing attributes and characteristics which permits ready and facile assembly and disassembly of the barrel and stock so as to afford ease of storage and transport.

Certain of the foregoing and related objects are readily attained in a firearm which includes a stock having a barrel end face, a generally longitudinally-extending primary bore formed therein and opening onto the barrel end face, and at least one generally transversely-extending, internally-threaded ancillary bore formed therein, one end of which opens onto the primary bore and the other end of which opens onto a lateral face of the stock. A double barrel is provided having a barrel end plate to which a bolt is secured. The bolt has an annular groove, and is demountably and rotably received within the primary bore such that the groove thereof is positional opposite the ancillary bore. At least one set screw is threadably received in the ancillary bore and has an inner end which is configured and dimensioned to permit substantially mating engagement thereof with the annular groove, so as to retain the bolt in the primary bore while permitting rotation thereof and, in turn, the double barrel.

In a preferred embodiment the bolt has a recessed rotatable sleeve mounted thereon in which the annular groove is defined. Most desirably the groove has a generally V-shaped cross-section.

Preferably, the groove has a cylindrical base wall and two downwardly and inwardly-tapered sidewalls and the end of the set screw is bevelled to substantially complement the cross-section of the groove and permit mating engagement therewith.

Most advantageously, the firearm includes a second generally, transversely-extending, internally threaded bore formed in the stock, the axis of which is aligned with the axis of the "at least one" ancillary bore, one end of which opens onto the primary bore and the other end of which opens onto a second lateral face of the stock, and a second set screw which is threadably receivable in the second ancillary bore. Most desirably, the firearm also includes a pair of metal, internally-threaded cylindrical sleeves mounted within the stock which define the "at least one" and second ancillary bores.

In a particularly preferred embodiment, the barrel end face has two detent-receiving recesses formed therein on opposite sides of the primary bore and the barrel end plate has mounted therein, on opposite sides of the bolt secured thereto, two spring-loaded detents which are disposed and positioned for releasable engagement with the recesses so as to permit rotation of the double barrel between a first and second releasable locking position, which positions are rotatably displaced 180 degrees from one another.

Finally, it is extremely advantageous that the sidewalls of the groove define therebetween an included angle of about 60 degrees, and that the end of the set screw has bevelled surfaces which are disposed at an angle of about 30 degrees to the axis of the set screw.

Other objects and features of the present invention will become apparent from the following detailed description considered in connection with the accompanying drawing which discloses one embodiment of the invention. It is to be understood, however, that the drawing is designed for the purpose of illustration only and not as a definition of the limits of the invention.

In the drawing wherein similar reference characters denote similar elements throughout the several views.

Figure 1:
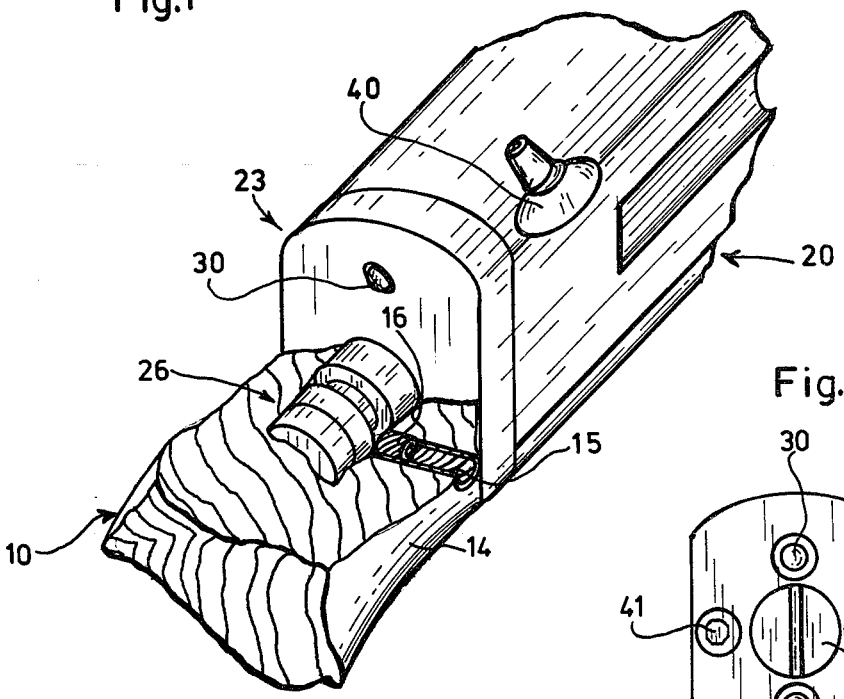
FIG. 1 is a fragmentarilly-illustrated, perspective view of a double-barrel firearm embodying the present invention, with a portion of the firearm stock broken away to shown internal construction.

Referring now in detail to the drawing, therein illustrated is a novel firearm embodying the present invention which includes a firearm or rifle stock 10. As can be seen more clearly in FIG. 5, stock 10 has a generally rectangular barrel end face 11 and an axially and longitudinally-extending, cylindrical primary bore 12 formed therein which opens onto barrel end face 11.

Stock 10 also has two oppositely-disposed, axially-aligned and transversely-extending, cylindrical ancillary bores 13, (only one of which is shown), the inner ends of which each open onto primary bore 12 and the outer ends of which each open onto opposite lateral faces 14 of stock 10. In each of bores 13, an internally-threaded, cylindrical metal sleeve 15 is mounted. A set screw 16 having a bevelled inner end 17 is threadably received in each of sleeves 15, the purpose for which will be described in greater detail hereinafter.

Figure 3:
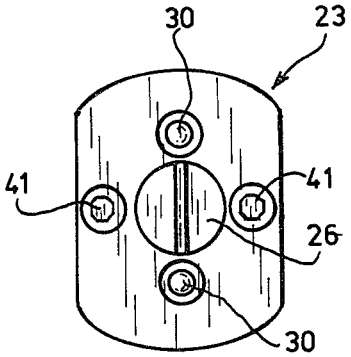
FIG. 3 is an end view of the firearm barrel.
Figure 2:
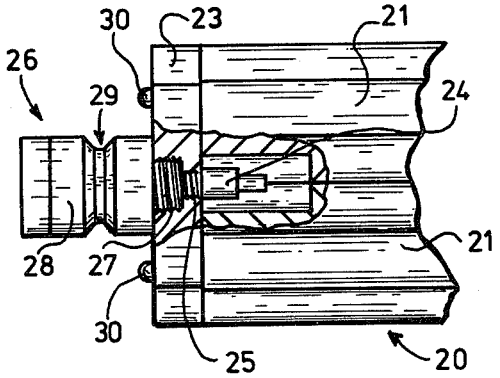
FIG. 2 is a fragmentarilly-illustrated, side elevational view, partly in section, of the firearm barrel.
Figure 4:
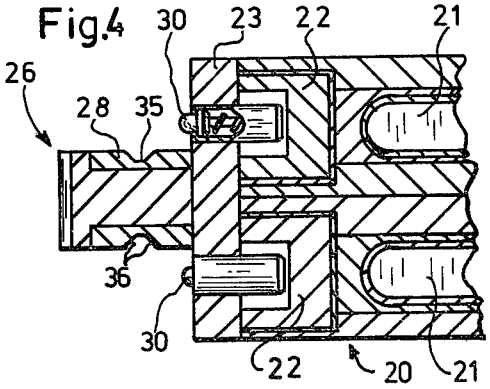
FIG. 4 is a fragmentarilly-illustrated, sectional view, in part elevation, of the firearm barrel.
Figure 5:
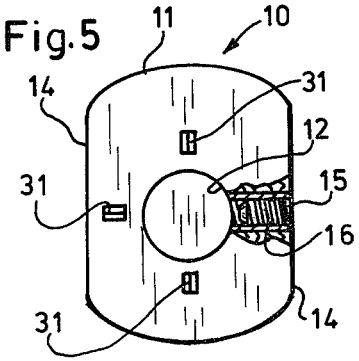
FIG. 5 is an end view, in part section, of the firearm stock.

As shown in FIGS. 3, 4 and 5, the firearm also includes an "over and under" double barrel 20 having two barrels 21 and two barrel support plugs 22 which is secured to a generally rectangular barrel end plate 23 by means of two set screws 41 and a mounting bolt 24; mounting bolt 24 being retained in the inner end of barrel 20 and having an inner threaded end 25 which is threadably received in end plate 23. A generally cylindrical coupling bolt 26 is also secured to barrel end plate 23 by means of a threaded inner end portion 27 which is threadably received in end plate 23; bolt 26 extending axially and rearwardly outwardly from end plate 23. Bolt 26 has a recessed rotatable sleeve 28 mounted thereon in which is formed an annular, generally V-shaped, bevelled groove 29 having a cylindrical base wall 35 and two inwardly tapered sidewalls 36, the sidewalls of which are preferably at an angle of 60 degrees to the basewall.

Figure 6:
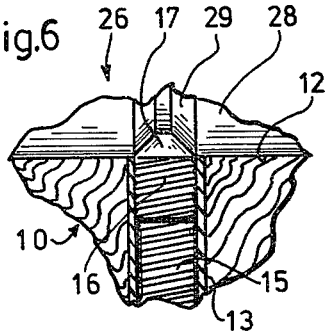
FIG. 6 is an enlarged, fragmentarilly-illustrated sectional view, in part elevation, showing the demountable coupling of the firearm stock to the barrel by means of a set screw which engages a grooved sleeve of a barrel bolt.

To demountably secure stock 10 and barrel 20 together, coupling bolt 26 is inserted into primary bore 12 of stock 10. In the fully inserted position (as shown in FIGS. 1 and 6), annular groove 29 will be aligned with ancillary bores 13. Then, set screws 16 are threaded into sleeves 15 (such as by means of an allen key wrench) until their bevelled inner ends 17 engage and mate with annular groove 29; the bevelled edges of screws 16 defining therebetween an inclined angle of 60 degrees so that a snug fit is ensured. As a result, barrel 20 will be firmly and snugly retained against stock 10. However, at the same time, it may be readily rotated since only sleeve 28 is held by screws 16 in a fixed position; the remainder of bolt 26 being rotatably displaceable in bore 12. Consequently, following the firing of one barrel (effected in a conventional manner by means of a hammer striking a percussion cup in cap holder 40), the barrel may be rotated to bring the other barrel into firing position.

In order to ensure the proper positioning of barrel 20, barrel end plate 23 is provided with two aligned spring-loaded detents 30, disposed respectively above and below bolt 26, which project rearwardly and outwardly from barrel end plate 23. Stock barrel end face 11 is provided with four detent-receiving V-shaped recesses 31 (only three of which are shown) radially and equidistantly disposed about bore 12.

In the firing position, detents 30 will be engaged within the upper and lower, vertically aligned recesses 31; the cooperative engagement of detents 30 and recesses 31 maintaining the barrel 20 in a first firing position. By rotating barrel 20 ninety degrees detents 30 will each engage with one of the lateral, horizontally-aligned recesses to maintain the barrel in a non-firing position. Upon rotating the barrel another ninety degrees or one hundred eighty degrees from the first firing position, the barrel will be rotated to a second firing position, in which the other barrel may then be fired.

As can be appreciated, the firearm can be easily disassembled for storage and transport. All that is required is to loosen set screws 16 so that they disengage from groove 29. Then, barrel 20 and bolt 26 may be simply withdrawn from bore 12 of stock 10.

While only one embodiment of the present invention has been shown and described, it will be obvious to those persons of ordinary skill in the art, that many changes and modifications may be made thereunto, without departing from the spirit and scope of the invention.

What is claimed is:

1. A firearm comprising:

a stock having a barrel end face, a generally longitudinally-extending primary bore formed therein and opening onto said barrel end face, and at least one generally transversely-extending internally-threaded ancillary bore formed therein one end of which opens onto said primary bore and the other end of which opens onto a lateral face of said stock;

a double barrel having a barrel end plate and a bolt secured to said barrel end plate having an annular groove, said bolt being demountably and rotatably received within said primary bore with said groove thereof being positioned such that it opposes said ancillary bore;

at least one set screw threadably receivable in said ancillary bore having an inner end which is configured and dimensioned to permit substantially mating engagement thereof with said annular groove, so as to retain said bolt in said primary bore while permitting rotation thereof and, in turn, said double barrel.

2. The firearm according to claim 1, wherein said bolt has a rotatable sleeve mounted thereon in which said groove is defined.

3. The firearm according to claim 2, wherein said groove has a generally V-shaped cross-section.

4. The firearm according to claim 3, wherein said groove has a cylindrical base wall and two downwardly and inwardly-tapered sidewalls and wherein said end of said set screw is bevelled to substantially complement the cross-section of said groove and permit mating engagement therewith.

5. The firearm according to claim 4, additionally including a second generally, transversely-extending, internally threaded bore formed in said stock, the axis of which is aligned with the axis of said at least one ancillary bore, one end of which opens onto said primary bore and the other end of which opens onto a second lateral face of said stock and a second set screw which is threadably receivable in said second ancillary bore.

6. The firearm according to claim 5, additionally including a pair of metal, internally-threaded cylindrical sleeves mounted within said stock which define said at least one and second ancillary bores.

7. The firearm according to claim 4, wherein said barrel end face has at least two detent-receiving recesses formed therein on opposite sides of said primary bore and wherein said barrel end plate has mounted therein, on opposite sides of said bolt secured thereto, two spring-loaded detents which are disposed and positioned for releasable engagement with said recesses so as to permit rotational movement of said double barrel between a first and second releasable locking position, which positions are rotatably displaced 180 degrees from one another.

8. The firearm according to claim 4, wherein said sidewalls of said groove define therebetween an included angle of about 60 degrees and wherein said end of said set screw has bevelled surfaces which are disposed at angle of about 30 degrees to the axis of said set screw.

* * * * *